US005267513A

United States Patent [19]

Guirguis et al.

[11] Patent Number: 5,267,513

[45] Date of Patent: Dec. 7, 1993

[54] DETONATION THROUGH SOLID-STATE EXPLOSION FIBER BUNDLE

[75] Inventors: Raafat H. Guirguis, Fairfax, Va.; Kibong Kim, Potomac, Md.

[73] Assignee: The United States of America as represented by the Secretary of the Navy, Washington, D.C.

[21] Appl. No.: 955,799

[22] Filed: Oct. 2, 1992

[51] Int. Cl.[5] ..... F42B 12/20

[52] U.S. Cl. ..... 102/475; 102/275.5; 102/285; 102/293; 102/473

[58] Field of Search ..... 102/20.1, 275.1, 275.5, 102/275.6, 275.8, 283, 285, 286, 287, 280, 289, 305, 473, 475, 701, 476

[56] References Cited

U.S. PATENT DOCUMENTS

| | | | |
|---|---|---|---|
| 660,567 | 10/1900 | Gathmann | 102/285 |
| 2,923,239 | 2/1960 | Andrew et al. | 102/275.5 |
| 3,429,264 | 2/1969 | Oversohl et al. | 102/285 |
| 3,989,934 | 8/1975 | Mercier et al. | 102/285 |
| 4,220,087 | 9/1980 | Posson | 102/275.6 |
| 4,384,527 | 5/1983 | Bugiel | 102/701 |
| 4,917,017 | 4/1990 | Beltz | 102/275.1 |

FOREIGN PATENT DOCUMENTS

| | | | |
|---|---|---|---|
| 1052581 | 1/1954 | France | 102/283 |
| 1125503 | 10/1956 | France | 102/473 |
| 478 | of 1879 | United Kingdom | 102/275.1 |

*Primary Examiner*—Harold J. Tudor

*Attorney, Agent, or Firm*—John D. Lewis; Jacob Shuster

[57] ABSTRACT

An explosive round is formed by a bundle of fibers made of explosive material held in peripheral contact with each other within an outer casing. Axially extending channel passages thereby extend between the fibers to conduct shock waves periodically impacting explosive blockage plugs in order to generate auxiliary detonation waves in forward and reverse directions. The auxiliary waves propagated in the reverse direction collide with the original detonation wave in the fibers between the blockage plugs at the locations of axial gaps between the fiber segments so as to reduce peak pressure oscillation.

4 Claims, 2 Drawing Sheets

DETONATION THROUGH SOLID-STATE EXPLOSION FIBER BUNDLE

BACKGROUND OF THE INVENTION

This invention relates in general to the modified propagation of energy pulses through a solid state material and is related to the invention disclosed and claimed in copending U.S. application, Ser. No. 07/955,800, filed Oct. 2, 1992, owned in common by the assignee of record herein.

According to the disclosure in the foregoing copending application, an energy pulse from a detonator usually causes propagation of a detonation wave through a body of explosive material at a self-sustained detonation velocity increased beyond its otherwise established limits by shock waves propagated more rapidly than the detonation wave. Such shock waves are propagated at a higher velocity through one or more smooth-bored or threaded channels formed in the body of explosive material. It is already known that blockage of a channel internally of an explosive body causes the shock wave in the channel to ignite the explosive at the end of the cavity. If the channel is periodically interrupted, periodic ignition occurs to cause an increase in the effective detonation velocity beyond that accomplished with a smooth continuous channel. Unfortunately, such velocity increase is accompanied by pressure oscillations not present in a continuous, open channel type arrangement.

It is therefore an important object of the present invention to provide a channel cavity arrangement in a solid-state explosive to increase the self-sustaining material consuming velocity of an energy pulse. An additional object is to effect such velocity increase without excessive pressure oscillations.

SUMMARY OF THE INVENTION

In accordance with the present invention, propagation of shock waves within solid-state explosive body of predetermined density and sensitivity, is modified by a novel arrangement of channel passages for "channel effect" increase in the rate of material consumption or detonation in the case of explosive material.

According to the invention, the "channel effect" arrangement includes a plurality of channel passages formed between fibers of a bundle constituting the solid-state body of material. The channel passages extend in the propagational direction of an energy pulse imparted at one end of the fiber bundle to produce during propation of such energy pulse, shock waves in advance thereof along the respective channel passages. According to certain embodiments of the invention, continuous channel passages between the bundle fibers are blocked by plugs at axially spaced locations for periodic interruption of the shock waves propagated therethrough. Also, the fibers may be divided into longitudinal segments spaced from each other by gaps at axial locations between the plugs in the channel passage where detonation wave collisions occur to reduce oscillating pressure peaks thereat caused by such collisions.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF THE PREFERRED EMBODIMENT

Figure 1:
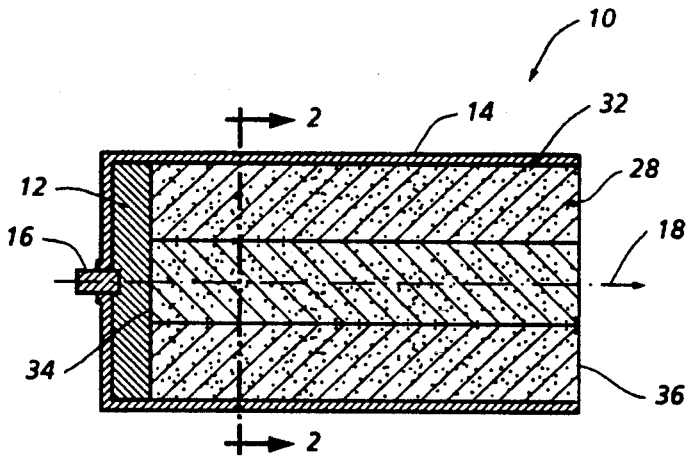
FIG. 1 is a side section view through an explosive charge device with which the present invention is associated in accordance with one embodiment thereof.

Referring now to the drawing in detail, an explosive munition round generally referred to by reference numeral 10 as shown in FIG. 1, has a generally cylindrical casing 14. An ignition detonator 16 projects into an explosive filler 12 at one axial end of the round 10. When energized, the detonator 16 and the explosive filler material adjacent thereto form a source of pulse detonation energy propagated forwardly in a direction along axis 18 of the explosive round at a self-sustaining detonation velocity which is dependent on the sensitivity and density of the propagation medium.

Figure 2:
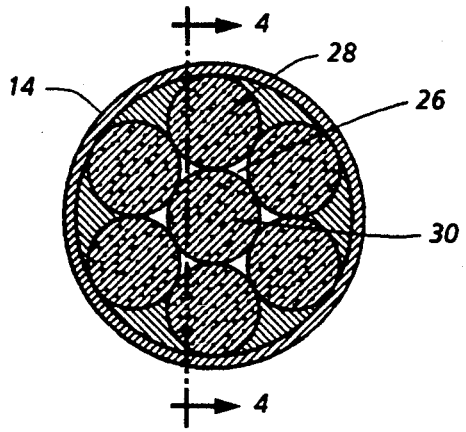
FIG. 2 is a transverse section view taken through a plane indicated by section line 2—2 in FIG. 1.
Figure 3:
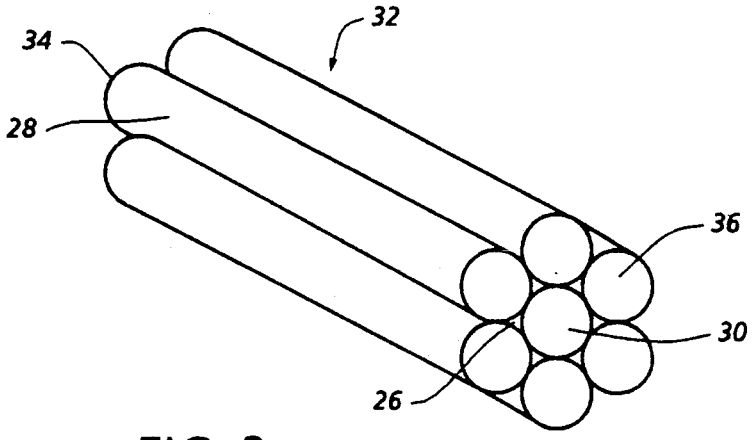
FIG. 3 is a perspective view of the bundle of fibers associated with the explosive charge device illustrated in FIGS. 1 and 2.

According to one embodiment of the invention, modification of the self-sustaining detonation velocity is achieved by means of the "channel effect" through a plurality of channel passages 26, as shown in FIG. 2, formed between a plurality of cylindrical explosive fibers 28 in peripheral contact with each other and with a central fiber 30 assembled in a bundle 32 enclosed within the casing 14. The bundle 32 constituting the body of explosive through which an energy pulse is propagated at the modified detonation velocity aforementioned, includes the assembly of fibers 28 and 30 more clearly shown in perspective in FIG. 3. Such an arrangement is capable of slightly increasing the detonation velocity. As shown in FIG. 1, the fibers extend continuously between the axial end 34 abutting the explosive filler 12 and the exit end 36 of the bundle 32. Each of the channel passages 26 is formed between two fibers 28 and the central fiber 30 extending continuously along the common axis 18 between the fiber ends 34 and 36 to conduct the shock waves associated with the "channel effect" for increasing detonation wave velocity.

Figure 4:
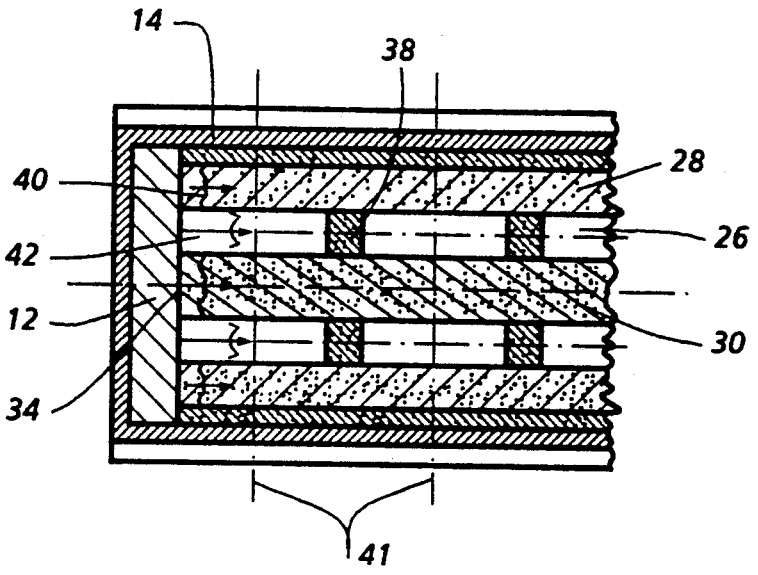
FIG. 4 is a partial side section view taken substantially through a plane indicated by section line 4—4 in FIG. 2.

To effect a larger increase in velocity of detonation waves 40 as denoted in FIG. 4, the channel passages 26 are provided with plugs 38 of sensitive explosive material so as to periodically block shock waves 42 propagated through the passages in advance of the detonation waves. When a shock wave 42 impacts a blockage plug 38, it ignites the explosive material thereof to generate forward and reverse auxiliary detonation waves within the three fibers 28 and 30 between which the channel passage 26 is formed. Since the shock waves 42 are propagated more rapidly in a forward direction along axis 18 than the original detonation wave 40 initiated at the fiber bundle end 34 as denoted in FIG. 4, the two auxiliary detonation waves are triggered by each shock wave impact before the original detonation wave 40 reaches the shock wave impacted plug 38 in a channel passage 26. Thus, reverse auxiliary detonation waves aforementioned collide with the original detonation wave 40 within the fibers at locations 41 rearwardly of each impacted plug 38, to create thereat a high peak pressure. Such collisions occur periodically and produce large pressure oscillations.

Figure 5:
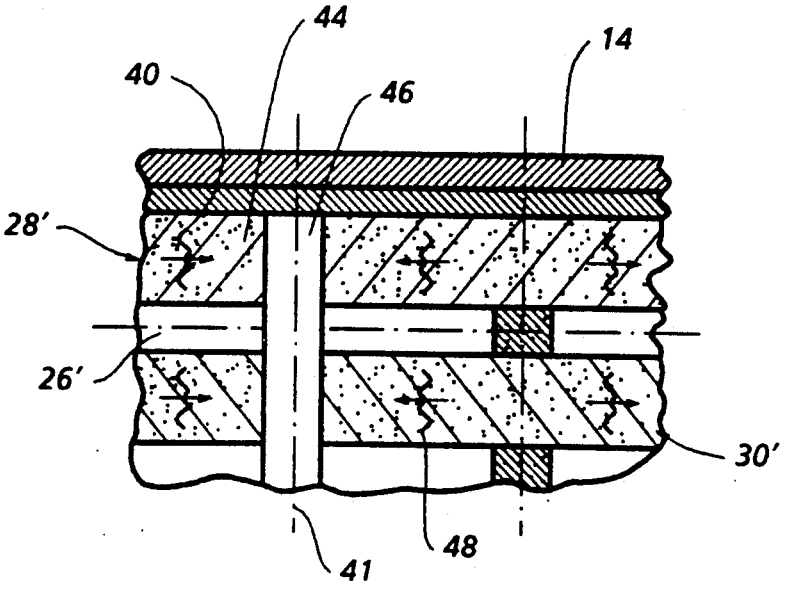
FIG. 5 is a partial side section view similar to that of FIG. 4 illustrating another embodiment of the invention.

In order to reduce the pressure peaks aforementioned, bundle of fibers 28' and 30' are divided into axial segments 44 according to the embodiment depicted in FIG. 5. The fiber segments 44 are spaced from each other by axial gaps 46 during bundle assembly. The axial gaps 46 in the respective fibers are furthermore aligned with each other between the 38, as shown in FIG. 5, at the expected locations 41 aforementioned at which collisions between forwardly propagated original detonation waves 40 and reverse auxiliary detonatin waves 48 caused by shock wave impact with the plugs 38. Pressure oscillations are thereby reduced by the foregoing fiber bundle construction and arrangement.

Numerous other modifications and variations of the present invention are possible in light of the foregoing teachings. It is therefore to be understood that within the scope of the appended claims the invention may be practiced otherwise than as specifically described.

What is claimed is:

1. In combination with a solid-state body having an axial end from which an energy pulse is propagated explosively by a power source at a self-sustaining velocity; channel means formed in said body for conducting shock waves generated by the energy pulse at a wave velocity greater than said self-sustaining velocity, comprising: a plurality of passages extending continuously from the power source at said axial end of the body along a common axis, said solid-state body being formed by a bundle of explosive fibers between which said passages are formed, and a plurality of sensitive explosive plugs spaced from each other along said common axis within the passages of the channel means.

2. The combination of claim 1 wherein said fibers of the bundle respectively comprise axial segments of explosive material spaced from each other by gaps, the gaps in the respective fibers being aligned at wave collision locations between the explosive plugs.

3. In combination with a bundle of solid-state explosive fibers through which an energy pulse is propagated from an explosive power source, a plurality of channel effect passages formed between said fibers through which shock waves are propagated in response to said energy pulse and explosive plug means within said passages in spaced relation to said power source for generating auxiliary waves colliding with the energy pulse at collision locations within the fibers in response to impact of the shock waves within the passages.

4. The combination of claim 3 wherein said fibers are respectively formed from segments axially spaced from each other by axial gaps at said collision locations.

* * * * *